US006952179B1

(12) United States Patent
Jones

(10) Patent No.: US 6,952,179 B1
(45) Date of Patent: Oct. 4, 2005

(54) RADAR SYSTEM

(75) Inventor: Michael Arthur Jones, Harrow (GB)

(73) Assignee: BAE Systems Electronics Limited, Hampshire (GB)

( * ) Notice: Subject to any disclaimer, the term of this patent is extended or adjusted under 35 U.S.C. 154(b) by 1826 days.

(21) Appl. No.: 07/163,563

(22) Filed: Jan. 26, 1988

(51) Int. Cl.[7] ..... F41G 7/00

(52) U.S. Cl. ..... 342/62; 342/13; 342/20; 342/59; 342/61; 244/3.15; 244/3.19; 343/872

(58) Field of Search ..... 343/872, 873, 343/895, 908, 909, 893; 342/52, 56, 59, 13–20, 61–68, 73–81, 147, 157, 158, 175; 244/3.1–3.3

(56) References Cited

U.S. PATENT DOCUMENTS 3,165,749 A * 1/1965 Cushner ..... 244/3.16
4,264,907 A * 4/1981 Durand, Jr. et al. ..... 244/3.15
4,324,491 A * 4/1982 Hueber ..... 244/3.16
4,384,290 A * 5/1983 Pierrot et al. ..... 244/3.19
4,477,814 A * 10/1984 Brumbaugh et al. ..... 342/53
4,562,439 A * 12/1985 Peralta et al. ..... 342/62
4,652,885 A * 3/1987 Saffold et al. ..... 342/53
4,776,274 A * 10/1988 Kriz et al. ..... 244/3.16

OTHER PUBLICATIONS

C.R. Seashore et al, "*MM–Wave Radar and Radiometer Sensors for Guidance Systems*", Microwave Journal, Aug. 1979 vol. 22, #8, pp. 47–51.*

* cited by examiner

*Primary Examiner*—Bernarr E. Gregory
(74) *Attorney, Agent, or Firm*—Kirschstein, et al.

(57) ABSTRACT

A dual mode radar seeker comprising a wide-band passive anti-radar antenna system (3) at the rear of a radome (1), operating at relatively low radar frequencies in an amplitude comparison tracking mode, and a high-frequency (W-band) active amplitude-comparison antenna system (5) in the nose of the radome (1) and having a common boresight with the anti-radar system. The active system employs coarse phase shift steering (31, 41) of the antenna 'beam' for the transmit and, optionally, also, the receive 'beam'. The high frequency and the use of phase shift steering both help to keep down the size of the active radar thus enabling it (5, 7, 9) to be positioned far forward in the nose of the radome (1) so as not to obscure the field of the anti-radar system (3).

8 Claims, 2 Drawing Sheets

RADAR SYSTEM

This invention relates to a radar system comprising a dual mode seeker for use in a guided missile.

It has been realised that, particularly in an anti-radar missile, it is desirable to employ a passive tracking radar responsive to the enemy radar transmission, and also an active radar for producing an independent target image.

According to the present invention, a dual mode seeker comprises a wide-band amplitude-comparison passive radar and a relatively high-frequency phased-array active radar mounted within a missile radome and having a common boresight aligned with the axis of the radome, the antenna of the active radar being mounted in the nose of the radome and being sufficiently small as to impose negligible obstruction in the field of the passive radar. The active radar may incorporate means for phasing both the transmitted and the received signals. The active radar may incorporate phase shifting means operative at radar frequency to effect phasing of the received signals. Alternatively, the active radar may incorporate phase shifting means operative at intermediate frequency to effect phasing of the received signals. In this case, the phase shifting means may be constituted by electronic angle tracking circuitry.

The portions of the radome employed by the respective radars may be constructed according to the frequency of operation and the physical and aerodynamic requirements of the respective locations on the radome.

One embodiment of a dual mode seeker in accordance with the invention will now be described, by way of example, with reference to the accompanying drawings, of which:

Figure 1:
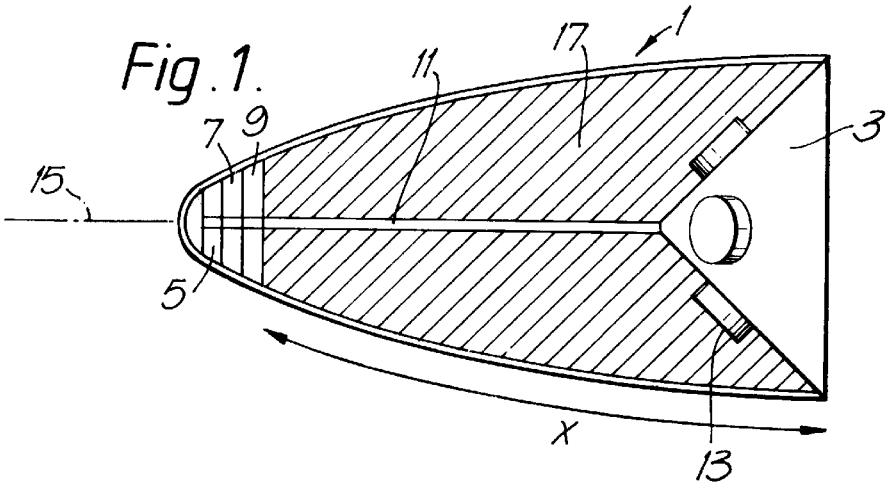
FIG. 1 is a diagrammatic cross-section of a missile radome and its dual mode seeker.
Figure 2:
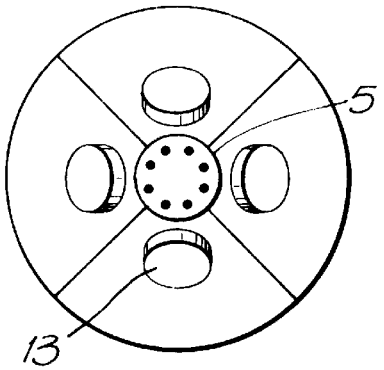
FIG. 2 is an end view of the missile with the radome removed.

Referring to the drawings, FIGS. 1 and 2 show the physical layout of the dual mode seeker. A radome 1 encloses two seeker systems. One has an antenna system 3 at the rear of the radome and is a passive system intended to detect enemy radiation, i.e. radar transmissions, within a wide band. The second system is an active system having a millimetre wave (MMW) 4-sector antenna at the very nose of the radome. The operating frequency may, for example, be in the W band, typically 94 GHz, which is high compared to the anti-radar range, 5–18 GHz, of the passive system. Such a high frequency permits the use of a small plate antenna 5 of small size commensurate with its high operating frequency which can thus fit far forward in the nose and provide a very small aperture obstruction to the passive antenna system. In addition to the antenna plate 5 itself, certain 'front-end' components are also positioned at the nose behind the antenna plate, being of small physical size and adding little or nothing to the obstruction. Thus the feed plate with duplexers 7 and receive mixers 9 (referred to subsequently) can be so positioned. Transmitter pre-amplifiers may be included. Connections between these components and the MMW transmitter/receiver are carried by way of a central waveguide 11, the MMW seeker being located behind the anti-radar antenna system 3 with the anti-radar seeker electronics.

The passive anti-radar system comprises four spiral antenna elements 13 mounted symmetrically on the faces of a pyramidal ground plane. The individual element characteristics overlap in the usual manner of an amplitude-comparison system to detect the angular location of a target off boresight, the boresight 15 coinciding with the axis of the radome 1 and missile.

Forward of the passive antenna system, the radome is filled with radar absorbent material (RAM) 17 to absorb stray radiation.

The region X of the radome cannot be tuned because of the wide range of the anti-radar system, but the nose of the radome in the region of the MMW antenna is formed of dense tough material tuned at half a wavelength at the MMW frequency to enhance the signals received from the target. This use of tough material is of great advantage in withstanding the temperature and pressure of flight.

Figure 3:
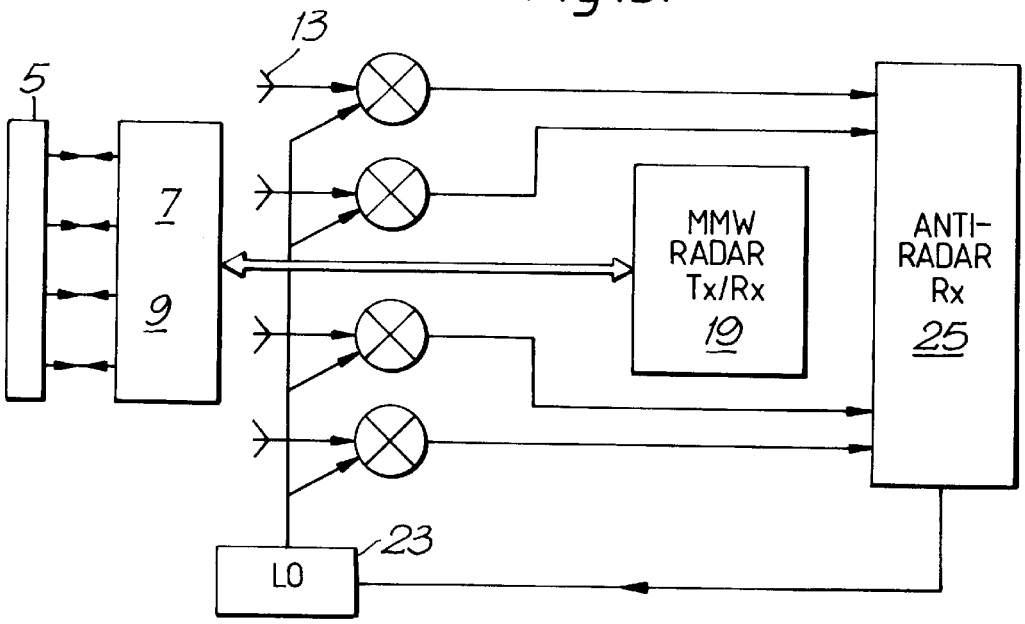
FIG. 3 is a block diagram of the basic dual mode seeker.

FIG. 3 shows, in block diagram, the basic arrangement of the dual mode seeker. The MMW radar comprises the antenna 5, 'front-end' 7 and 9, and transmitter/receiver equipment 19. The anti-radar elements 13 are shown coupled to mixers 21 employing a local oscillator 23, the I.F. signals being applied to the anti-radar receiver 25 for analysis of target location.

While the anti-radar seeker is a normal amplitude comparison system the MMW seeker with which it is combined essentially employs phased-array techniques for steering the antenna characteristic. This enables the MMW system to avoid the use of a mechanically steerable antenna which would take up more space and cause significant obstruction to the anti-radar antenna system.

Figure 4:
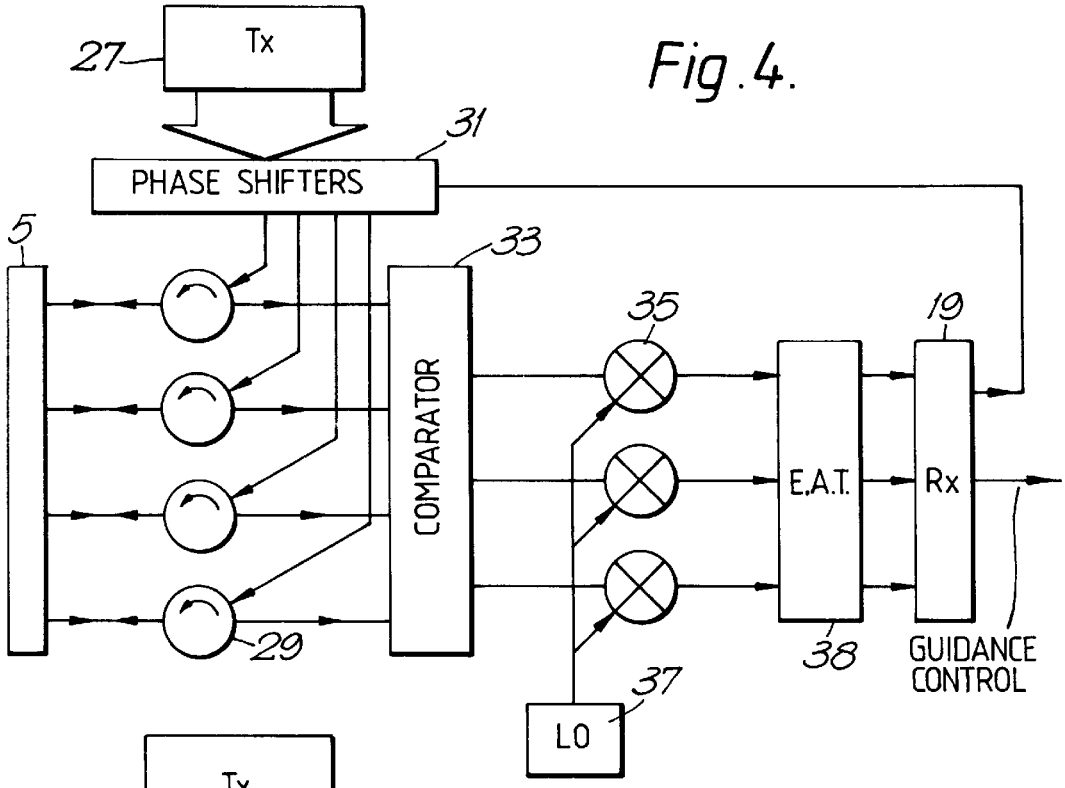
FIG. 4 is a block diagram of one phased-array system providing transmit and receive beam steering.

FIG. 4 shows one example of a phased-array system for the MMW radar. The W-band transmitter 27 is coupled to the antenna 5 by way of duplexers 29. Between the transmitter 27 and duplexers 29, a phase shift array 31 is interposed, providing a graduated phase shift between the four transmitted signals so as to steer the direction of the wave front in known manner. The phase shifters 31 are controlled by the receiver 19 output so as to track the target. Because of the very high frequency involved at this stage the phase controlled tracking is rather coarse.

The received signals are applied to a comparator 33 to provide azimuth difference, elevation difference, and sum signals in known manner which are reduced to I.F. by mixers 35 and local oscillator 37. The I.F. signals are then subjected to an electronic angle tracking arrangement 38 which effectively provides very fine adjustment of the coarsely steered beam to track the target closely. Electronic angle tracking (E.A.T.) is performed, in known manner, by combining a controlled fraction of the sum signal with the difference signals to tend to reduce the difference signals to zero, the control factor then indicating the target angle. The signals so produced are then processed by the receiver 19 to guide the missile.

Figure 5:
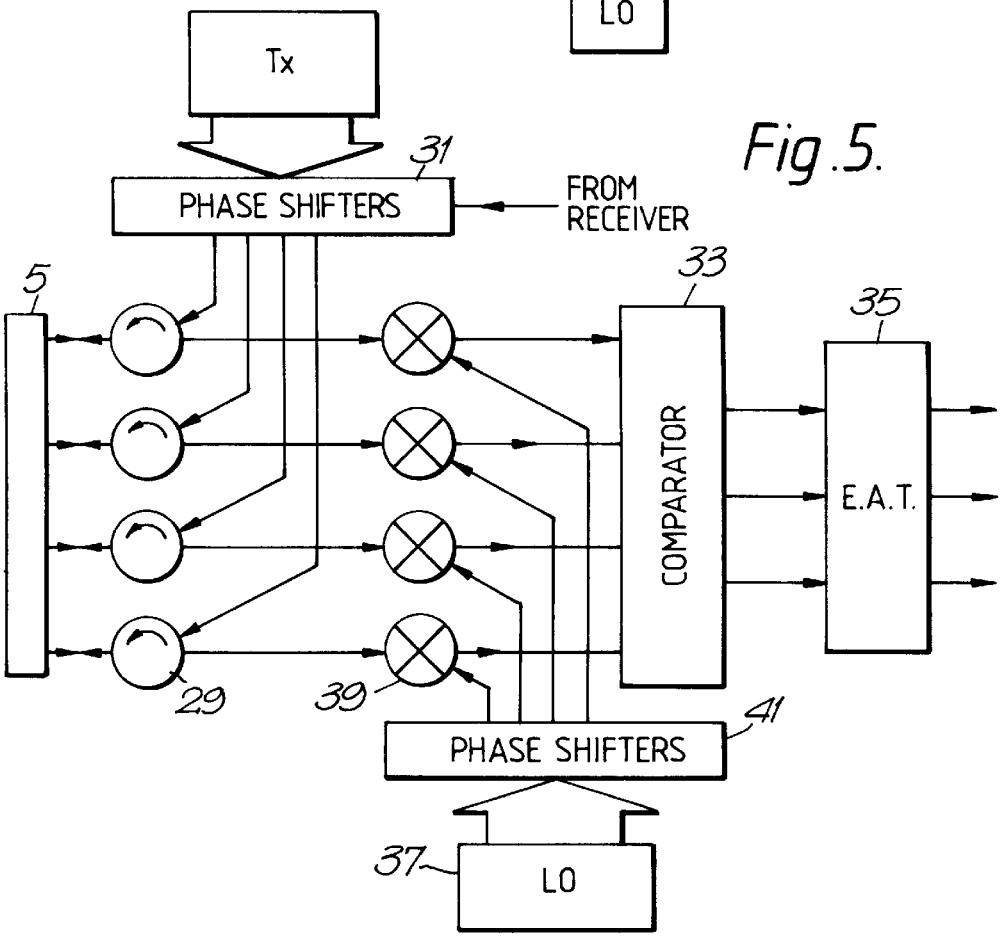
FIG. 5 is a similar diagram of a more developed phased-array system.

In a modification of the arrangement of FIG. 4, FIG. 5 shows the additon of coarse phase steering to the received signals of FIG. 4. The coarsely steered signals received from the duplexers 29 are applied to mixers 39 before the comparator 33. The local oscillator 37 is subject to a further phase shift array 41 in similar manner to the transmitted signals, so as to provide coarsely steered received signals to the comparator 33. The comparator then operates at I.F. and applies sum and difference I.F. signals to the E.A.T. system again providing fine received characteristic steering.

The combination of the high-frequency phased-array active seeker with the relatively low-frequency passive seeker is thereby possible in the same radome with each seeker having its own, largely unobscured, aperture.

In operation, the initial tracking will be performed by the anti-radar passive seeker and the active seeker will come into its own as an imaging radar at shorter range, particularly if the enemy target radar should cease transmission temporarily.

What is claimed is:

1. A dual mode seeker comprising a missile radome having a longitudinal axis, a wide-band amplitude-comparison passive radar and a high-frequency phased-array active radar, said passive radar and said active radar having a common boresight aligned with said longitudinal axis and said active radar having an antenna mounted in the nose of said radome forward of said passive radar and being of small size commensurate with its high operating frequency such as to present negligible obstruction in the field of said passive radar.

2. A dual mode seeker according to claim 1, wherein said active radar incorporates means for phasing both the transmitted and the received signals.

3. A dual mode seeker according to claim 1, wherein said active radar incorporates phase shifting means operative at radar frequency to effect phasing of the received signals.

4. A dual mode seeker according to claim 1, wherein said active radar incorporates phase shifting means operative at intermediate frequency to effect phasing of the received signals.

5. A dual mode seeker according to claim 4, wherein said phase shifting means is constituted by electronic angle tracking circuitry.

6. A dual mode seeker according to claim 1, wherein said active radar comprises transmitting and receiving circuitry and said antenna is connected to said transmitting and receiving circuitry by an axial feed extending through an antenna of said passive radar.

7. A dual mode seeker according to claim 1, wherein the portions of said radome employed by the respective radars are constructed according to the frequency of operation and the physical and aerodynamic requirements of the respective locations on the radome.

8. A dual mode seeker according to claim 1, wherein said active radar operates at millimetric wavelengths.

* * * * *